United States Patent [19]

Franklin et al.

[11] Patent Number: 4,850,623

[45] Date of Patent: Jul. 25, 1989

[54] LOCKING MECHANISMS

[75] Inventors: Roy W. Franklin, Potters Bar; Nicholas G. Luckett, Wolverhampton, both of England

[73] Assignee: Chubb & Son's Lock and Safe Co., Ltd., London, England

[21] Appl. No.: 609,371

[22] Filed: May 11, 1984 (Under 37 CFR 1.47)

[30] Foreign Application Priority Data

May 12, 1983 [GB] United Kingdom ..... 8313142

[51] Int. Cl.[4] ..... E05B 47/00

[52] U.S. Cl. ..... 292/144; 70/267; 74/483 R

[58] Field of Search ..... 292/150, 144, 336.3, 292/201, 33; 70/267, 68, 69; 74/483 R

[56] References Cited

U.S. PATENT DOCUMENTS

| | | | |
|---|---|---|---|
| 3,800,572 | 4/1974 | Beharelle | 70/267 X |
| 3,907,343 | 9/1975 | Goodwin | 292/144 X |
| 4,132,439 | 1/1979 | Millar | 292/144 |

*Primary Examiner*—Richard E. Moore

*Attorney, Agent, or Firm*—Pollock, Vande Sande & Priddy

[57] ABSTRACT

The release mechanism of an electronic timelock employs two bistable electromagnetic actuators to control the "on-guard" and "off-guard" conditions of the lock, each actuator comprising an element of ferro-magnetic material whose magnetic polarity serves as the "memory" of whether the lock is in an on- or off-guard period and which polarity is reversed by single magnetizing pulses through associated coils when each successive on- and off-guard period is programmed to commence.

More particularly, when on-guard the coils are pulsed in one direction to magnetize the actuating elements so that they are attracted by specified poles of associated field magnets. In this condition the actuating elements block a beam which is pivotted centrally to a bolt which in turn blocks a bar which is attached to the door's boltwork. When off-guard the coils are pulsed in the opposite direction to reverse the magnetization of the actuating elements so that they are attracted by the other poles of the associated magnets. This enables the beam to be lifted with the bolt as a spring snib on the bolt rides up a notch in the aforesaid bar when the latter is retracted. If the bar is forced when the mechanism is locked the snib is turned until a face on the bar is blocked by the bolt, thus limiting the force which can be applied through the beam to the actuating elements. If one actuator should for any reason fail in the on-guard position the lock can still be released when the other actuator switches to the off-guard position, by pivotal movement of the beam.

8 Claims, 6 Drawing Sheets

LOCKING MECHANISMS

The present invention relates to locking mechanisms.

In one aspect the invention provides an electromechanical locking mechanism which in a preferred embodiment is intended principally for effecting the mechanical locking/unlocking function in an electronically-controlled timelock, although mechanisms of like character may equally find application, e.g. in electronic code-recognition locks for access-control purposes, or more generally in any electromechanical locking situation where there is a need for operation with minimal power consumption.

In accordance with this aspect of the invention, a locking mechanism comprises a bolt or other such locking member movable between locking and unlocking positions; at least one electromechanical actuator arranged for selectively disabling or enabling movement of said locking member from its locking to its unlocking position; the, or each said actuator, comprising first magnetic means including an element of magnetizable material and means for applying a pulsed magnetizing field thereto, the said magnetizable material being such that said element is capable of repeated reversals of its magnetic polarity in response to the application thereto of magnetizing pulses of reverse senses and is capable of remaining magnetized with the last-induced polarity between such pulses, and second magnetic means for providing a predetermined magnetic field to interact with the remanent magnetism of said element, whereby said actuator is biased by the magnetic interaction between said element and said second magnetic means to move to a first or a second position respectively to disable or enable said movement of the locking member in dependence upon the sense of the last-applied said pulse; and control means for causing said pulse to be applied in a first sense in response to a locking command and for causing a said pulse to be applied in the reverse sense in response to an unlocking command.

Typically, the magnetizable element in an actuator of the aforesaid mechanism may be in the form of a bar pivoted at one end and surrounded by a coil through which the magnetising pulses are applied, while the aforesaid second magnetic means comprise a permanent magnet defining opposed poles between which the opposite end of the bar lies, whereby the bar is influenced at any instant to pivot towards one or other of the permanent magnet poles in dependence upon the sense of the last-induced polarity of the bar. The opposite end of the bar, or a member carried by it, can therefore serve as an abutment to block or free the locking member to move to its unlocking position, in the two respective pivotal positions of the bar.

In use of a mechanism as defined above, since only a pulse of magnetising energy is required to reverse and retain the polarity of the magnetizable element(s) in the aforesaid actuator(s), little power is consumed in switching an actuator between its two states, as distinct from e.g. the conventional solenoid which consumes power for the whole of the time that it is in the "energised" state. Furthermore, by remaining magnetized with the last-induced polarity between pulses, the magnetizable element in effect "remembers" its most recent command so that, for example, if the actuator is blocked or otherwise restrained from moving into its position appropriate to that command at the instant when the corresponding pulse is given, it will nevertheless move into and remain in the correct position under the remanent magnetic influence as soon as the aforesaid restraint is removed, without having to be pulsed again at that time. The particular advantages of this characteristic in the context of an actuator for use in a timelock mechanism will appear from the ensuing description.

A preferred material from which to make the abovementioned magnetizable element, having a desirably low energy requirement for reversing its magnetic polarity coupled with a usefully high remanence, is a heat-treated cobalt-iron alloy containing vanadium such as the material marketed by Telcon Metals Limited under the name "Vicalloy".

In another aspect, the invention provides a locking mechanism comprising a bolt or other such locking member movable between locking and unlocking positions; a beam extending transversely with respect to the path of unlocking movement of the locking member and being pivotally mounted thereto at a location intermediate the ends of the beam; and a pair of actuating devices (preferably, though not essentially, electromechanical actuators of the type defined above) juxtaposed to respective ends of said beam; each said device including an abutment movable between two positions arranged such that in a first said position the abutment lies in front of the respective end of the beam in the direction of the unlocking movement of the locking member, and such that in a second said position the abutment lies clear of the beam; whereby when each said abutment is in its first said position, unlocking movement of the locking member is blocked through the beam; when each said abutment is in its second said position, unlocking movement of the locking member is permitted by the beam; and when either one of said abutments is in its first said position while the other abutment is in its second said position, the beam can pivot with respect to the locking member, against the abutment which is in its second said position, to permit unlocking movement of the locking member.

Such a mechanism is particularly useful as the release mechanism of a dual-channel or "duplex" timelock (each channel controlling the condition of a respective said actuating device). In the event of some failure in one of the channels while the mechanism is locked (i.e. with the actuator abutments in their "first" positions), so that the respective abutment fails to move out of its first position when the relevant locking time period has elapsed, the correct response of the remaining actuator will still enable release of the locking member thus avoiding the expense and inconvenience of a "lock-out".

These and other aspects of the present invention will now be more particularly described, by way of example, with reference to the accompanying drawings, in which.

Figure 4A:
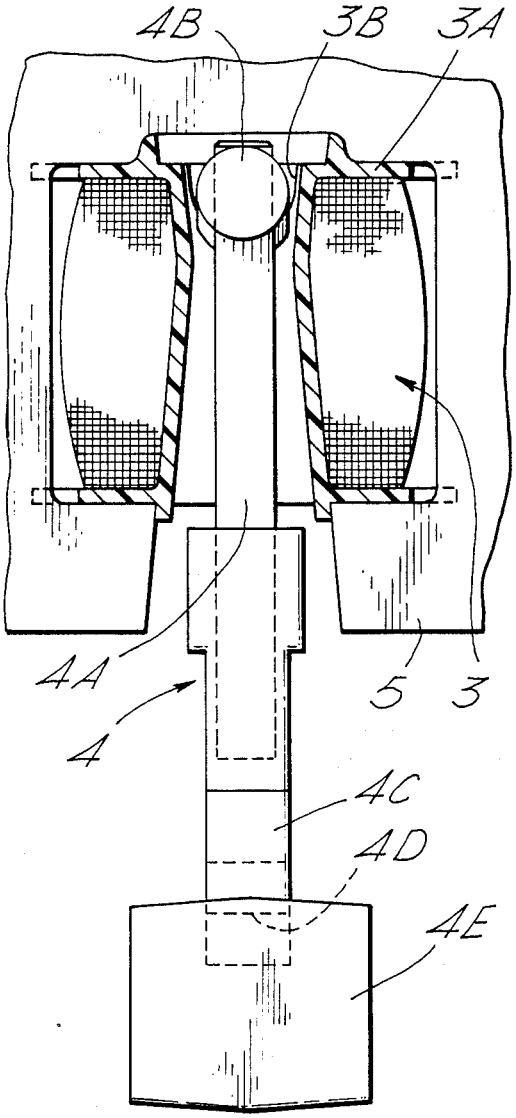
Figure 4B:
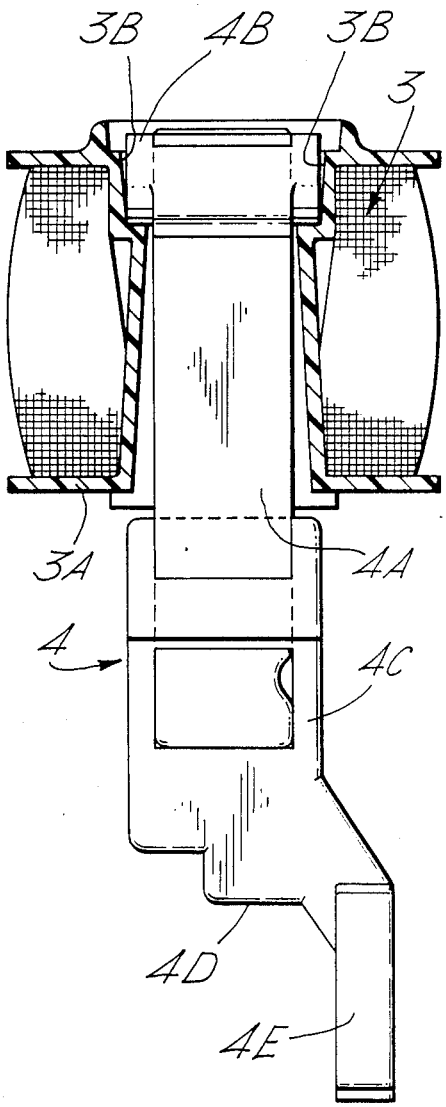
Figure 5:
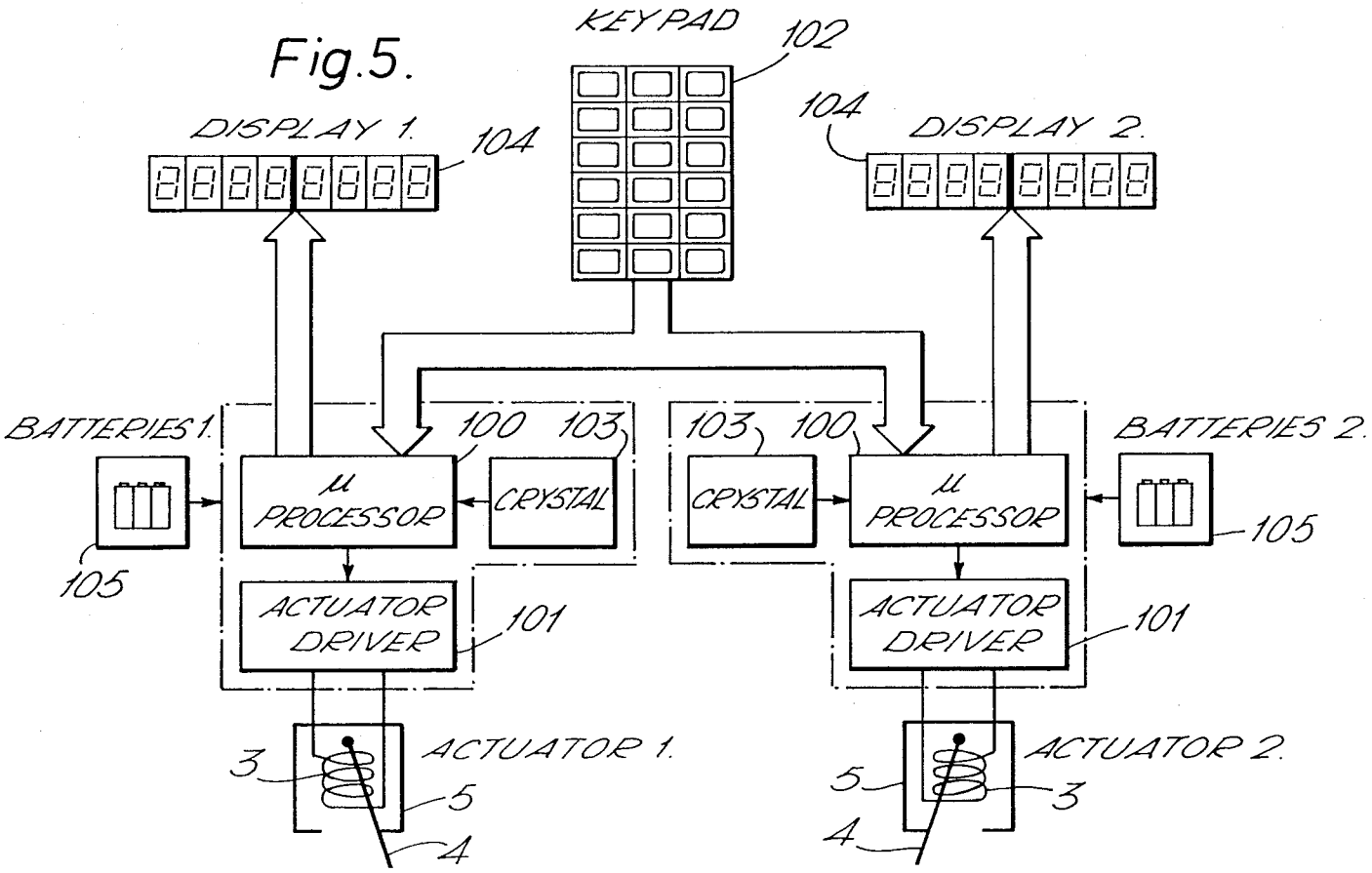

FIGS. 4*a* and 4*b* are vertical sections taken at right angles to one another through an actuating member and associated coil bobbin comprised in the release mechanism;

FIG. 5 is a schematic block diagram of the control system for the lock; and

Figure 1:
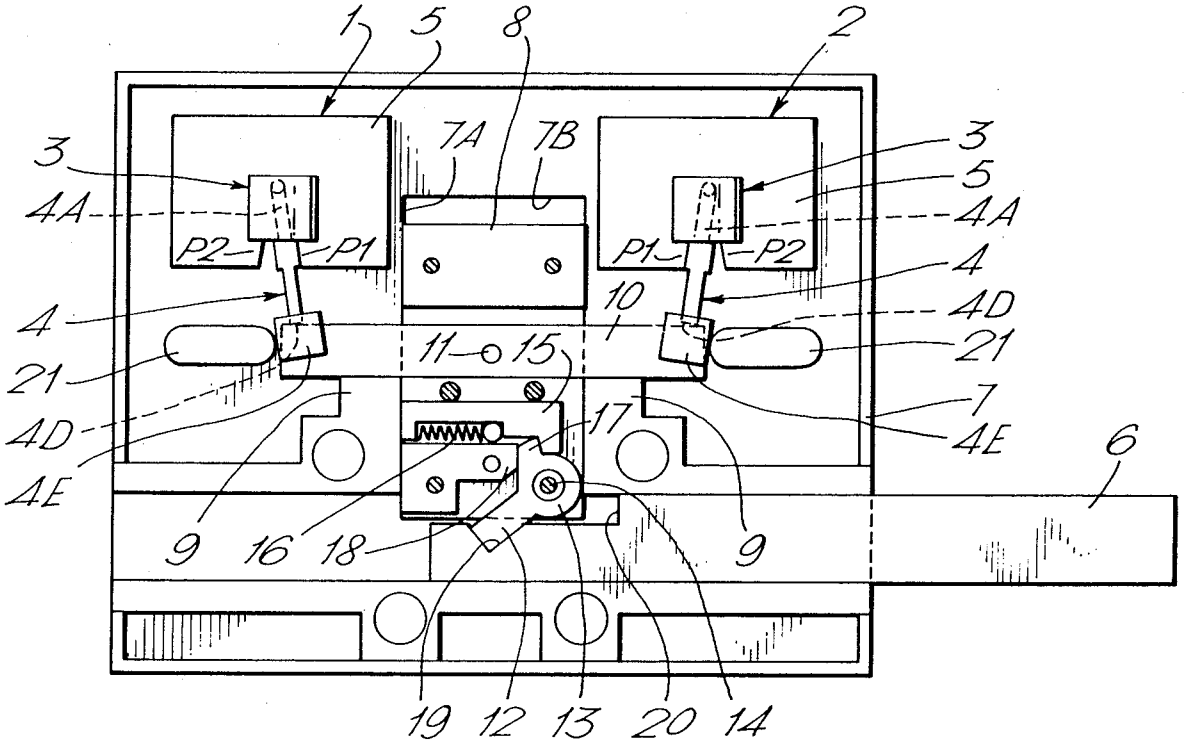
FIG. 1 shows the release mechanism of a dual-channel electronically-controlled timelock, in the locked condition.
Figure 2:
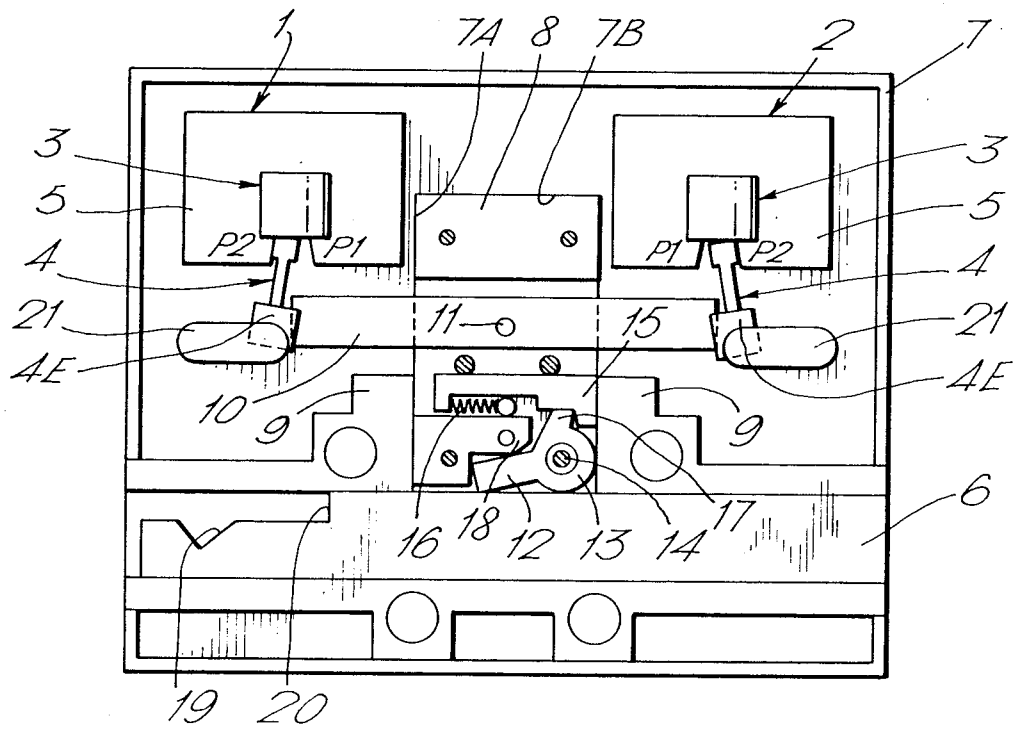
FIG. 2 shows the mechanism of FIG. 1 in the normal unlocked condition.
Figure 3:
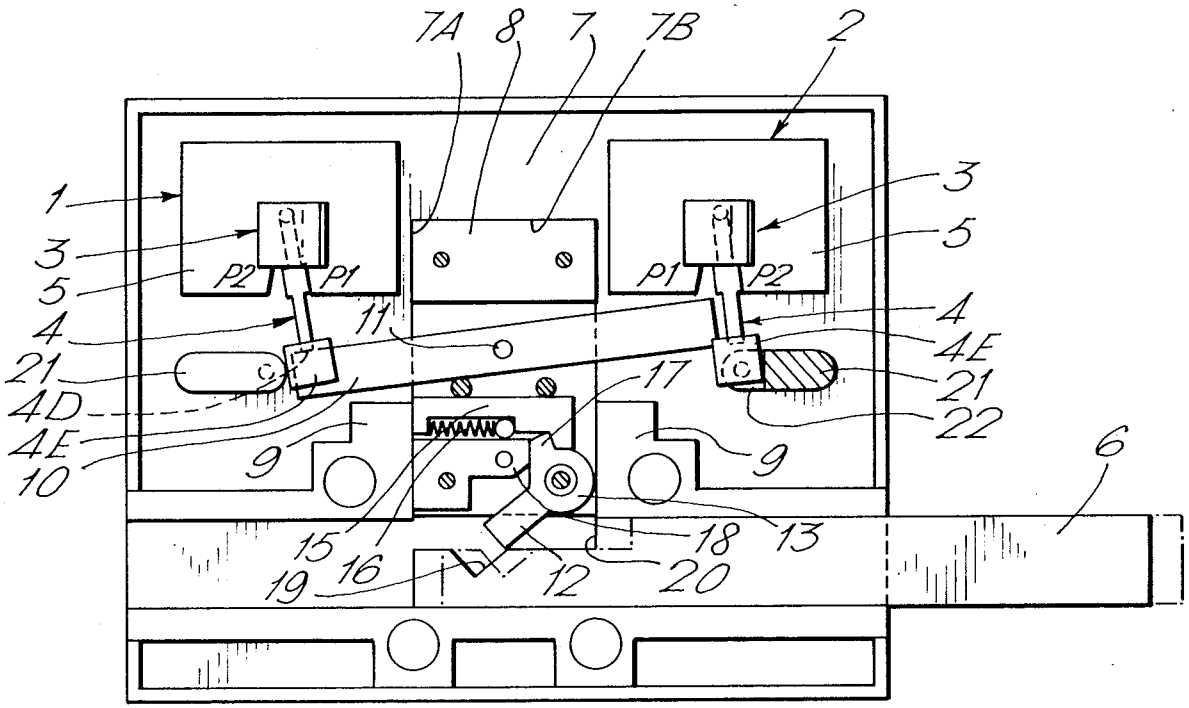
FIG. 3 shows the same mechanism with only one channel unlocked.
Figure 6:
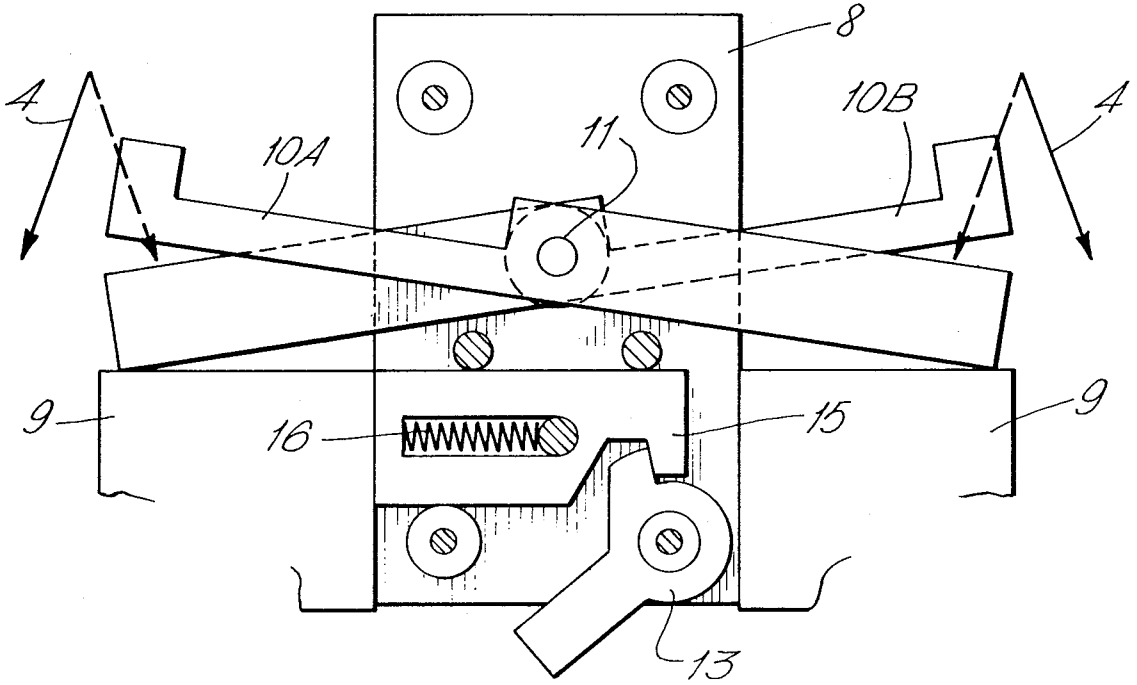

FIG. 6 shows a modification of part of the mechanism of FIGS. 1–3, in the unlocked condition.

The mechanism shown in FIGS. 1–3 includes two bistable electromechanical actuators 1 and 2. Each actuator comprises a magnetizing coil 3 within which is pivoted an actuating member 4. A rectangular horseshoe permanent magnet 5 surrounds the coil 3, with the actuating member 4 extending through the gap between the magnet poles P1 and P2. That part of each actuating member 4 which extends within the corresponding coil 3 and between the associated permanent magnet poles, is made from a piece of magnetizable material such as heat-treated Vicalloy.

An example of the construction of an actuator for use in this release mechanism is shown in FIGS. 4*a* and 4*b*. A bar 4A (which may be laminated) of Vicalloy is fitted at one end with a plastics cap 4B by which it is pivotally suspended in a pair of recesses 3B formed inside the coil bobbin 3A. The bar 4A extends out of the bobbin 3A to lie between the poles of the associated field magnet 5 and at its lower end is fitted with a plastics tip piece 4C. This tip piece provides an abutment surface 4D and a mask portion 4E, for purposes to be described hereafter. The actuator is assembled by passing the Vicalloy bar 4A with its cap 4B through the top of the coil bobbin 3A and snapping on the tip piece 4C. The coil is then assembled to the magnet 5 which retains the actuating member against ejection through the top of the bobbin.

In use, the actuating members 4 can be flipped between two positions (as indicated by comparing their positions in FIGS. 1 and 2) in response to pulses of electricity passed through the associated coils 3 in opposite directions. For example, if it is assumed that the magnet pole P1 in actuator 1 is a North and P2 a South, then if an electrical pulse is sent through the associated coil 3 in the direction such as to induce a North pole at the top end of the Vicalloy element 4A within the coil and a South pole at the bottom end of that element between the poles P1 and P2, the element will be attracted by pole P1 and repelled by pole P2 so as to pivot the actuating member into the position in which it is shown in FIG. 1. The remanence of the element 4A is sufficient to keep the actuating member in that position until an electrical pulse is sent through the coil 3 in the opposite direction, whereupon the induced polarity of the element 4A is reversed so that its end between the poles P1 and P2 now becomes a North, and it will be influenced oppositely by the permanent magnet poles to pivot the actuating member into the position in which it is shown in FIG. 2. The actuating member of actuator 2 can be influenced to move between its two positions in like manner.

In use, each actuator coil 3 receives pulses from a respective channel of a dual channel electronic timing circuit, schematically illustrated in FIG. 5. This circuit contains two CMOS microprocessors 100 controlling respective driver circuits 101 for the actuators, and which can be programmed simultaneously by a common key pad 102 to provide selected daily "on guard" (i.e. locked) and "off guard" (i.e. unlocked) periods. For timing accuracy, each microprocessor is equipped with a standard 32 $KH_z$ watch crystal 102. The microprocessors also drive respective liquid crystal displays 104 to indicate the next programmed "on guard" and "off guard" times together with other indications, warnings and prompts appropriate to the setting and operation of the lock, the details of which do not form part of the present invention. Power for all of the functions of the control circuits, actuators and displays is provided by batteries 105.

The polarity of the magnets 5 and the directions of the corresponding pulses sent through the coils 3 when an "on" or "off guard" event occurs are so arranged that in response to "on guard" command signals from the microprocessors, the actuators 1 and 2 are pulsed to pivot their actuating members towards one another as shown in FIG. 1, and in response to "off guard" command signals, the actuators are pulsed to pivot their actuating members in the respectively opposite directions as shown in FIG. 2.

Description will now be directed to the remainder of the mechanism shown in FIGS. 1–3, by which the locking and unlocking functions commanded by the electronic circuit are effected.

The illustrated lock is assumed to be fitted to the door of a bank vault. A bar 6 is secured to one of the boltstraps (not shown) of the main boltwork of the door so as to slide horizontally through the lockcase 7 as the door bolts are thrown and withdrawn. With reference to FIG. 1, this shows the bar 6 in the position in which the door bolts are thrown, withdrawal of those bolts requiring movement of the bar to the left as viewed in that figure. The lock includes a vertically-sliding bolt 8, mounted between the actuators 1 and 2, to obstruct withdrawal of the bar 6 (and thus block the door bolts) during "on guard" periods. This lock bolt is borne in a guideway 7A in the lockcase and extends between two relatively massive pillars 9, and is biased downwardly by its own weight. A balance beam 10 is mounted to the bolt 8 through a central pivot 11, so as normally to lie perpendicularly to the path of movement of the bolt. In the FIG. 1 condition, this beam rests on the tops of the pillars 9 to define the limiting obstructing position of the bolt 8. This figure also shows that when the actuators 1 and 2 are pulsed to their "on guard" positions, the surfaces 4D of the actuator tips lie directly in front of respective ends of the beam 10 (in the sense of the upward, releasing movement of the bolt 8); the mask portions 4E of the actuator tips are, however, offset so as to overlap the beam 10. When the actuators 1 and 2 are pulsed to their "off guard" positions, their members 4 pivot away from one another (as shown in FIG. 2), to lie clear of the beam 10.

Extending from the bottom of the bolt 8 is a lever arm 12, this being provided on a snib 13 pivoted to the bolt at 14. A plunger 15 biased by a spring 16 acts on another arm 17 of this snib to urge it to the illustrated rotary position against a stop 18. When the vault door bolts are thrown and the bar 6 is in its corresponding (rightward) position, the lock bolt 8 drops into the position of FIG. 1 in which the arm 12 engages with a notch 19 in the bar 6. When the actuating members 4 are pivoted away from one another to their "off-guard" positions, clear of the beam 10, and the door bolts are withdrawn to slide the bar 6 to the left, the inclined edge presented by the arm 12 rides upon the inclined face of the notch 19 to lift the bolt 8 clear of the retracting bar, the spring 16 being sufficiently stiff, having regard to the weight of the bolt 8 and beam 10, to keep the snib 13 from turning during this movement. As the lever arm 12 rides out of the notch 19, the bolt 8 reaches the limit of its permitted travel in the guideway 7A and is arrested by a face 7B at the guideway end; (the position of the bolt 8 with respect to the bar 6 at this point is indicated in FIG. 3—although the actuator 1 and beam 10 are shown in different positions in that figure). Further retracting movement of the bar 6 brings a perpendicular face 20 thereon into contact with the lever arm 12, and the latter is thus rotated against the bias of the spring 16 as the bar moves to its fully retracted position as shown in FIG. 2.

If an attempt is made to retract the door bolts and bar 6 while the actuators are in the "on guard" position of FIG. 1, the tendency of the bolt 8 to lift as the bar 6 is pressed against the arm 19 will be resisted by the actuating members 4, blocking the path of the beam 10 (the actuating members themselves abutting at their upper ends against the respective field magnets 5). Force on the boltwork in the retracting direction may cause the bar 6 to move a short distance, turning the snib 13 against the bias of spring 16, until the perpendicular face 20 on the bar comes into contact with the bolt 8. In this condition, further end pressure on the bar 6 is resisted directly by the bolt 8 in its mounting between the pillars 9, and does not place any further upward load on the bolt. In other words, the spring snib 13 serves to limit the force which can be applied through the bolt against the actuating members 4 when "on guard", to prevent damage to the actuators if the bar 6 is forced. Of course, the distance through which the bar 6 retracts from its normal thrown position to bring the face 20 up against the bolt 8 is insufficient to permit release of the door's boltwork; typically this distance may be 6 mm where the total throw of the bar is in the range 35–50 mm.

It has been mentioned that during the time between pulses through the actuator coils 3, the last-induced polarity of the magnetizable elements 4A is retained, so that this polarity serves effectively as a "memory" of the most recent command signal. The importance of this characteristic in relation to the illustrated mechanism will now be explained.

It may well occur that at the time when an "on guard" period is programmed to commence following an "off guard" period, the normal operations of the bank are such that the vault door is still open and will not be closed and locked until later. While the door is open and the boltwork retracted, the bar 6 is in its leftward position with the bolt 8 raised above it and the beam 10 lying between the actuating members 4, as shown in FIG. 2. In this condition, when the coils 3 receive their "on guard" pulses, the polarity of the elements 4A is reversed so that the resultant magnetic forces influence the actuating members to pivot towards one another, but movement into their "on guard" positions is blocked by the presence of the beam 10. However, the magnetic influence on the actuating members remains, so that as soon thereafter as the door is closed and its bolts thrown, the bar 6 is shifted, the bolt 8 and beam 10 drops clear of the actuators, and the members 4 flip over into their "on guard" (FIG. 1) positions without any further command signals being given.

Similarly, at the time when an "off guard" period is programmed to commence following an "on guard" period, it may be that a previous attempt has been made to open the door—quite legitimately—against the blocking action of the bar 6, so that at the instant when the "off guard" pulse is given, the beam 10 is loaded upwards against the actuating members 4 and prevents them from moving. However, as soon thereafter as the pressure on bar 6 is relieved by returning the boltwork to its fully-thrown condition, the members 4 will be unloaded and freed to flip into their "off guard" (FIG. 2) positions, again without the need for any further command signals.

It will be understood that the dual-channel release mechanism described and illustrated herein is "redundant" in that, in principle, the bolt 8 could be blocked and released by use of a single actuator suitably located in its release path. However, it is common practice in the (mechanical) timelock art to provide "duplex" operation where two separate clock movements are provided to establish the "on guard" periods and the running of either one to the end of the set period is sufficient to effect unlocking. This duplication ensures that the failure of a single clock movement will not result in a catastrophic "lock out", and the same philosophy is applied to the electronic circuitry and associated mechanical release mechanism of the lock described herein. This operation will be explained with reference to FIG. 3.

In FIG. 3 it is assumed that the end of a programmed "on guard" period has been reached. Actuator 2 has been pulsed to flip its member 4 to the "off guard" position but the actuating member of actuator 1 remains in its "on guard" position, either through some failure in the actuator itself or, for example, in the power supply, timing or driving dircuitry of the associated electronic channel. The right hand end (as viewed) of the beam 10 is therefore unrestrained but its left hand end remains blocked by the "stalled" actuator 1. By virtue of the pivotal connection between the beam 10 and bolt 8, however, the bolt can still be raised to release the bar 6, in so doing the beam pivoting on the bolt against the member 4 of actuator 1, and swinging clear of the member 4 of actuator 2. FIG. 3, in fact, shows the mechanism at the point where the lever arm 12 has just ridden out of the notch 19, in which condition the bolt 8 has just risen clear of the bar face 20 and been arrested by the stop face 7B, further retraction of the bar 6 causing the snib 13 to rotate against the spring 16 as further upward movement of the bolt is limited. Release of the mechanism if actuator 1 operates and actuator 2 fails is equivalent, with the beam 10 pivoting the other way.

Of course, once a channel has failed as indicated above the timelock ought not to be used again until the fault has been rectified. In order, inter alia, to detect the occurrence of a "stalled" actuator, the positions of the actuating members 4 are monitored by respective transducers 21. These may comprise photoelectric devices having a slot 22 (see FIG. 3) across which an infra red light beam is transmitted and detected, the mask 4E of the associated actuating member extending into the slot to interrupt the beam when in the "off guard" position.

The actuators 1 and 2 described herein consume very little power in changing between their "on guard" and "off guard" states owing to the low power requirement of the magnetizable elements 4A for reversing their polarity, and to the fact that only a single pulse is required to achieve each change of state. In one practical example each actuator coil 3 comprises 750 turns of 0.14 mm wire, wound as 54 turns per layer and 14 layers, giving a total resistance of 25 ohms; the field strength in the centre of the gap in each permanent magnet 5 is 750 gaus; and the electrical energy in each magnetizing pulse is 100 milli-Joules, supplied by discharging a 220 micro-Farad capacitor charged to 30 volts. The maximum magnetizing force occurs 2 milliseconds after switching, the respective microprocessor supplying a control pulse of 20 milliseconds for each magnetization. This develops a force of 15 grams attraction and 5 grams repulsion as measured at the tip of a 20 mm long Vicalloy element 4A. It is estimated that a dual-channel timelock employing actuators 1 and 2 of this nature can be constructed to run for periods in excess of two years, with four changes of state for each actuator daily, solely from the power provided from, for example, six type MN1500 manganese alkaline batteries.

In the "on guard" condition, the illustrated mechanism is virtually immune to being released by any series of blows upon the lockcase 7, in contrast to certain prior art timelock mechanisms, it being understood that to unblock the bar 6 at least one actuating member 4 would have to be displaced against its magnetic influence while at the same time the bolt 8 is shot upwards i.e. requiring simultaneous movements in perpendicular directions.

Finally, turning to FIG. 6, this shows a modification to part of the mechanism of FIGS. 1–3, the operation of which will not be explained. In this case, in place of the single beam 10 pivoted to the bolt 8, there are two beams 10A and 10B in parallel, both engageable at each end by the respective actuating members 4. The latter are indicated only schematically in FIG. 6, each being depicted by a full-line arrow in its "off-guard" position and by a broken-line arrow in its "on-guard" position. When the bolt 8 is in its locking position, the two beams 10A,10B rest horizontally on top of the pillars 9 and the "on-guard" actuating members 4 block both ends of both beams, to equate with the locking condition of the FIG. 1 mechanism. When, however, the actuators go "off-guard" and the bolt 8 is raised, the two beams pivot in scissor fashion as shown in FIG. 6, i.e. so that one end of each beam remains resting on the adjacent pillar 9 while its opposite end swings clear of the opposite actuating member 4. This occurs because one limb of each beam is relieved as shown to provide a definite weight imbalance about the central pivot 11. However, in the event that one actuator should fail to go "off-guard" after an "on-guard" period as previously described in relation to FIG. 3, the beams can still be pivoted against their natural inclination to enable the bolt to be lifted with only one actuator "off-guard".

The reason for adopting this double-beam arrangement has to do with a preferred mode of fault monitoring. In this mode, not only do the microprocessors 100 monitor the absolute positions of the actuating members 4 via the transducers 21, but they also repeatedly compare the positions of the actuators to ensure that they are at all times in the same "on-guard" or "off-guad" condition. If the actuators are detected to be in different positions at any time, a "FAIL" message will be displayed and further use of the lock may be inhibited. With the single-beam arrangement, this situation could conceivably occur if the bolt 8 is raised when an "on-guard" command is given and if the beam 10 is for some reason tilted out of the horizontal (e.g. through inertia or vibration effects on moving the door). In this situation, one (only) of the actuators could be blocked by the beam from moving into its "on-guard" position and the "FAIL" message would therefore display, although in reality no failure has occurred as the blocked actuator would move "on-guard" as soon as the bolt dropped to realign the beam horizontally. The double-beam arrangement overcomes this problem by ensuring that when the bolt is raised the beams 10A and 10B must pivot oppositely to block both actuating members 4.

We claim:

1. A locking mechanism, comprising: a locking member movable between locking and unlocking positions; at least one electromechanical actuator for selectively disabling or enabling movement of said locking member from its locking to its unlocking position; said at least one actuator comprising first magnetic means including an element of magnetizable material and means for applying a pulsed magnetizing field thereto, said magnetizable material being such that said element is capable of repeated reversals of its magnetic polarity in response to the application thereto of magnetizing pulses of reverse senses and remains magnetized with a polarity determined by the polarity of the last magnetic pulse applied thereto, and second magnetic means juxtaposed to said element for providing a predetermined magnetic field to interact with the remanent magnetism of said element, means responsive jointly to said magnetic field of said second magnetic means and to said remanent magnetism of said first magnetic means to move said actuator to a first or second position to respectively disable or enable said movement of the locking member in dependence upon the sense of the last-applied said pulse; and control means for causing a pulse to be applied in a first sense to said first magnetic means in response to a locking command and for causing a said pulse to be applied in the reverse sense to said first magnetic means in response to an unlocking command.

2. A mechanism according to claim 1 wherein said first magnetic means comprise an element of said magnetizable material in the form of a bar pivoted at one end and surrounded by a magnetizing coil through which said pulses are applied; and said second magnetic means comprise a permanent magnet defining opposed poles between which the opposite end of said bar lies; whereby the bar is influenced at any instant to pivot towards one or other of said permanent magnet poles in dependence upon the sense of the last-induced polarity of the bar.

3. A mechanism according to claim 1 wherein said magnetizable element controls the position of an abutment to block the unlocking movement of said locking member in said first position of the actuator and to free the locking member for such movement in said second position of the actuator.

4. A mechanism according to claim 1 wherein there are two said actuators arranged such that when each actuator is in its first said position the actuators collectively disable the unlocking movement of said locking member and when each actuator is in its second said position the actuators collectively enable such movement of the locking member; and means effective when either one of the actuators is in its first said position while the other actuator is in its second said position to enable movement of said locking member.

5. A mechanism according to claim 4 wherein the locking member carries a beam extending transversely with respect to the path of unlocking movement thereof and pivotally mounted to the locking member at a location intermediate the ends of the beam, the two said actuators being juxtaposed to respective ends of said beam; each said actuator including an abutment arranged such that in said first position of the actuator the abutment lies in front of the respective end of the beam in the direction of the unlocking movement of the locking member, and such that in said second position of the actuator the abutment lies clear of the beam; whereby when each said actuator is in its first said position unlocking movement of the locking member is blocked through the beam; when each said actuator is in its second said position unlocking movement of the locking member is permitted by the beam; and when either one of said actuators is in its first said position while the other actuator is in its second said position the beam can pivot with respect to the locking member, against the abutment of the actuator which is in its second said position, to permit unlocking movement of the locking member.

6. A mechanism according to claim 5 wherein the locking member is arranged for unlocking movement in a generally vertical path and carries two said beams pivotally mounted thereto in parallel; the two beams being constrained to lie generally horizontally when the locking member is in its locking position but being weighted such as to pivot from the horizontal in mutually opposite senses when the locking member moves to its unlocking position.

7. A mechanism according to claim 1 wherein said locking member serves as an abutment, when in its locking position, to block the retraction of a further member borne by guide means to move in a direction generally perpendicular to the direction of unlocking movement of the locking member; the locking member carrying a spring-biased tongue which engages with an inclined surface of said further member to move the locking member to its unlocking position when enabled as aforesaid and when said further member is urged in its direction of retraction; and the arrangement being such that when said further member is urged in its direction of retraction when the locking member is disabled as aforesaid, said tongue is displaced against its spring bias by the initial movement of said further member and thereafter a face of the further member comes into abutment with the locking member, whereby further force upon the further member in its direction of retraction is resisted by the locking member without applying further force to the locking member in its direction of unlocking movement.

8. A locking mechanism comprising a locking member movable between locking and unlocking positions; a beam extending transversely with respect to the path of unlocking movement of the locking member and being pivotally mounted thereto at a location intermediate the ends of the beam; and a pair of actuating devices juxtaposed to respective ends of said beam; each said device including an abutment movable between two positions arranged such that in a first said position the abutment lies in front of the respective end of the beam in the direction of the unlocking movement of the locking member, and such that in a second said position the abutment lies clear of the beam; whereby when each said abutment is in its first said position unlocking movement of the locking member is blocked through the beam; when each said abutment is in its second said position unlocking movement of the locking member is permitted by the beam; and when either one of said abutments is in its first said position while the other abutment is in its second said position the beam can pivot with respect to the locking member, against the abutment which is in its second said position, to permit unlocking movement of the locking member.

* * * * *